United States Patent [19]

Borcoman

[11] 4,061,454

[45] Dec. 6, 1977

[54] FACTORY-TYPE APPARATUS FOR PRODUCING PRESTRESSED CONCRETE PRODUCTS

[76] Inventor: Mircea Borcoman, 20, rue de Boulainvilliers, 75016 Paris, France

[21] Appl. No.: 668,930

[22] Filed: Mar. 22, 1976

[30] Foreign Application Priority Data

Mar. 27, 1975 France ..... 75.09580

[51] Int. Cl.[2] ..... B28B 1/10; B28B 5/04; B28B 23/04

[52] U.S. Cl. ..... 425/88; 425/111; 425/126 R; 425/257; 425/261; 425/404; 425/432; 425/443

[58] Field of Search ..... 425/88, 111, 126, 257, 425/259, 261, 432, 443, 448, 453, 456, 219, 404; 264/228, 229

[56] References Cited

U.S. PATENT DOCUMENTS

| | | | |
|---|---|---|---|
| 3,577,613 | 5/1971 | Hidden | 425/111 |
| 3,659,986 | 5/1972 | Gelbman | 425/432 |
| 3,666,388 | 5/1972 | Oberwelland et al. | 425/453 |
| 3,720,493 | 3/1973 | Borcoman et al. | 425/11 |
| 3,732,044 | 5/1973 | Borcoman | 425/439 |

FOREIGN PATENT DOCUMENTS 83,594 12/1956 Netherlands.

*Primary Examiner*—Francis S. Husar
*Assistant Examiner*—John McQuade
*Attorney, Agent, or Firm*—Larson, Taylor and Hinds

[57] ABSTRACT

A factory for manufacturing concrete products, in particular prestressed concrete products, comprising a rotary supporting housing of a general cylindrical shape, having a horizontal axis of rotation and conveying moulds, for the concrete products, placed on its internal surface. The rotary housing comprises a circular carrier structure supported by means permitting the rotation of the said carrier, and a structure, resistant to longitudinal stresses, arranged in the interior of the carrier structure. The resistant structure comprises, on the one hand, longitudinal recesses adapted to receive sets of moulds, and, on the other hand, at one longitudinal end means for the attachment of reinforcement wires of the concrete products and, at its other longitudinal end, means for tensioning the reinforcement wires, such that the tensile stresses of these wires are taken up exclusively by the aforesaid resistant structure.

31 Claims, 15 Drawing Figures

FACTORY-TYPE APPARATUS FOR PRODUCING PRESTRESSED CONCRETE PRODUCTS

The invention relates to a monoblock factory for the manufacture of concrete products, in particular prestressed and/or reinforced concrete products, of the type of the said factories comprising a rotary carrier housing of general cylindrical shape, having in particular a horizontal axis of rotation, and conveying the moulds to be used for the concrete products, the said moulds being placed on its internal surface so that they pass in front of various working stations mounted on a construction arranged in the interior of the housing, the said working stations comprising in particular a concreting installation, a heat-treatment installation, a mould-stripping and manufactured products discharging installation and a wire-feeding installation.

A factory of this kind is particularly described in U.S. Pat. No. 3,732,044 (BORCOMAN).

It is the primary object of the invention to render the installation such that it enables the various practical requirements to be met better than heretofore, and in particular such that it is simple and effective in operation, permitting high outputs, coupled with the manufacture of concrete products at low costs, while ensuring good quality of the said products.

According to the invention, a monoblock factory for the manufacture of concrete products, in particular prestressed and/or reinforced concrete products, of the kind hereinbefore defined, is characterised in that the rotary housing comprises a circular carrier structure having a horizontal axis, supported by means permitting the rotation of the said carrier structure on its axis, and a structure resistant to longitudinal stresses parallel to the axis of the carrier structure, the said resistant structure being arranged in the interior, in the radial direction, of the carrier structure and being fixed to the latter, the resistant structure comprising longitudinal recesses extending parallel to the axis of rotation of the carrier structure, the said recesses being adapted to receive sets of moulds for the products to be manufactured, the said resistant structure comprising at one longitudinal end means for the attachment of reinforcement wires for the concrete products, and at its other longitudinal end means for tensioning the reinforcement wires, such that the tension stress on these wires is taken up exclusively by the aforesaid resistant structure.

Advantageously, the circular carrier structure comprises at both of its longitudinal ends a circular ring of profiled cross-section, adapted to run on runways of the carrier structure, the two end rings being connected rigidly to each other by longitudinal elements, preferably tubular, the aforesaid carrier structure being situated in the central part of the rotary housing, the resistant structure projecting from either end of the said carrier structure.

The resistant structure preferably comprises longitudinal girders parallel to the axis of rotation of the carrier structure, arranged in the interior radially of the said structure and fixed to it, in particular to the said rings, in particular by welding, these longitudinal girders being spaced apart regularly over a complete circumference, so as to form between them the recesses for the moulds, and being connected together at their longitudinal ends by transverse ties spaced apart radially so as to leave a free radial space for the passage of the means for pulling the reinforcement wires.

The longitudinal beams have a cross-section substantially of isosceles trapezoid shape, the small base of which is turned towards the axis of rotation of the rotary housing.

The concrete casting means intended to be placed between two longitudinal girders comprise:

on the one hand, a shell formed by a number of a unit moulds placed transversely side-by-side and connected rigidly together, each unit mould permitting a product to be manufactured, and on the other hand a framework on which is fixed the shell, this framework being carried by the longitudinal girders and in particular being situated, in the case in which these moulding means are used in a monoblock factory comprising a rotary housing of the kind hereinbefore defined, towards the outside in the radial direction, such that the moulds are open towards the interior of the carrying structure, and on the other hand, a cover for closing the mould towards the interior in the radial direction, the covers of a row of shells placed between two longitudinal girders being carried by a longitudinal supporting element extending throughout the entire length of the housing.

Means for holding the supporting element, to which the covers are fixed, are provided at each end of the housing. The covers bear on the surface of the concrete contained by the shells.

The means for holding the supporting element of the covers comprise advantageously at each end of the factory a rail shaped in the arc of a circle bearing against the ends, in particular provided with rollers, of the supporting element. This rail exerts a radial force tending to press the supporting element and the covers against the metal moulds.

The "monoblock factory" or "production line" comprises means for removing the covers from the moulds, when the setting of the concrete is sufficient, and for returning the said covers to the moulds, at the end of the concrete pouring operation. In general, pouring of the concrete is effected when the moulds occupy the lower position of their circular trajectory, that is to say, when they are horizontal at the bottom point of the trajectory.

The means for taking over the covers comprise, at the top end of the rail in the form of an arc of a circle, a pivotal member, in particular controlled by a jack, adapted to drive the end of the supporting element towards a guide track for returning this supporting element and the covers to the lower position referred to.

A driving device, in particular a chain, is provided for ensuring the return of the said supporting element and the covers to the lower position, along the guide track.

The reinforcement wires of the concrete extend along the entire axial length of the longitudinal girders on which the moulds are placed and pass through several sets of moulds arranged one after the other between two longitudinal girders.

The means for tensioning the reinforcement wires, apart from conventional means such as hydraulic jacks and stops, comprise a device whereby the tension applied to the reinforcement wires can be gradually diminished at the end of the manufacturing operation.

This device comprises stop means placed at the end of the longitudinal girders where the operation of tensioning is effected and the longitudinal position of which stop means, with respect to the end of the girders, is continuously adjustable.

The adjustment of the longitudinal position of the stop means may be ensured by a screw and nut device.

The screw is fixed to the end of the girders and extends in the longitudinal direction of the said girders; the nut mounted on the said screw acts as retention member for the stop means when the reinforcement wires are put under tension.

These stop means comprise in particular two transverse elements spaced apart to allow a free passage for the reinforcement wires; the faces of these elements turned towards the girder are intended to bear against a plate abutting against the said nut, while the other faces of the transverse elements serve as stops for a plate against which bear the means for pulling the reinforcing wires and the wedges intended to maintain the said reinforcing wires in the tensioned condition.

With such a tensioning device, at the end of the manufacturing operation, unscrewing of the nut permits reduction of the length of the reinforcement wires by a value corresponding to the sum of the elongations of the parts of these wires situated outside the moulds; this reduction in length is made possible by the sliding of the framework of the moulds.

According to a modification, the device permitting gradual reduction of the tension applied to the reinforcement wires comprises a head ensuring simultaneous tension of all the reinforcements of the moulds placed side by side situated between two longitudinal girders, and a device with wedges having opposite slopes, the said wedges being placed between the pulling head and a fixed stop, the whole being such that the displacement of the pulling head in a direction perpendicular to the reinforcements, towards the interior of the shop is accompanied, due to the arrangement of the wedges, by a gradual reduction of the space between the pulling head and a fixed stop; and therefore by gradual reduction in tension of the reinforcement.

This movement of the pulling head towards the interior of the housing takes place during stripping of the moulds, when the concrete products are pushed out of the moulds.

The pouring installation for pouring the concrete into the moulds arranged one after the other between the longitudinal girders comprises a transport truck for receiving the concrete to be poured and moving along the row of moulds and stopping above the moulds to be filled; a feature of this concrete pouring installation resides in the fact that an intermediate feed truck is provided between the hopper containing the concrete (and situated outside, in the longitudinal direction, of the girders carrying the row of moulds) and the transport truck, the feed truck being adapted to slide longitudinally along the direction of the row of moulds and to be filled with concrete from a principal bin containing the concrete when the transport truck has moved away for filling the moulds, the said feed truck having dimensions such that it collects an amount of concrete corresponding to that necessary for filling a mould, the bottom of this feed truck being adapted to open widely for ensuring rapid transfer of the concrete contained in the said feed truck to the transport truck, when the feed truck is above the transport truck.

A buffer bin may be provided between the principal bin and the feed truck for storing the excess concrete which has run from the principal bin to the feed truck.

Advantageously, the feed truck and transport truck comprise side walls forming a continuous contour, the dimensions of which are determined in such a manner that the concrete collected by the feed truck corresponds to that required to fill the moulds according to the type of products to be manufactured, the said walls, which form a belt, being laid on a horizontal bottom formed of two shutters adapted to slide horizontally for opening or closing, in particular by the action of a hydraulic jack.

The concrete pouring installation advantageously comprises a smoothing device adapted to move on guide means, in particular the same guide means as those of the transport truck, the said smoothing device being situated, in the inoperative position, outside the axial direction of the row of moulds arranged one after the other, the said smoothing device comprising a bin containing concrete for ensuring complete filling of the moulds, and a vibrating head adapted to move on the upper surface of the moulds, the said vibrating head comprising a scraper and being supported by a vertical adjustment device to permit its positioning at an appropriate level, in particular for crossing obstacle.

The concrete pouring installation also comprises mould-vibrating means formed by at least one horizontal girder for each set of moulds, in particular perpendicular to the vertical plane passing through the longitudinal axis of the row of moulds and supported by lifting means, in particular hydraulic jacks, with the possible interposition of elastomer material means for filtering the vibrations, the whole being such that the girder is brought into contact with the mould during the filling of the said mould with concrete.

Preferably, attachment means are provided for attaching the girder or girders of the vibrating means to the moulds.

The monoblock factory for the manufacture of concrete products comprising a rotary housing comprises an installation for the heat-treatment of the concrete products, which heat-treatment installation extends substantially along an arc of a circle corresponding to part of the circular trajectory of a mould and commences, according to the direction of rotation of the housing, after the concrete pouring station, the said heat-treatment installation comprising a fixed heat screen situated outside the housing and resting on the latter by rotating rollers, the said heat screen comprising a metal framework and possibly a sheet of heat insulating material, in particular a sheet of plastics material, a second heat screen being provided in the interior of the rotary housing and being formed by a double wall of heat-insulating material, the said interior screen extending along an arc of a circle or along a polygonal contour, the space between this interior screen and the internal faces of the moulds being preferably closed radially at both ends by movable walls, such as curtains, movable aside to give a free passage.

Heating means may be arranged between the external heat screen and the moulds so as to send a flow of heat towards the moulds passing in front of the said heating means.

These heating means may comprise infrared radiators, heated by gas or electricity.

The monoblock factory also comprises a reinforcement-wire feeding device for the concrete elements, this feeding device being arranged just upstream of the concrete pouring station.

This feeding device comprises a tubular element parallel to the axis of the housing, around which element there are disposed, at regular intervals, circular rings provided with radial recesses opening on the external periphery of the rings, the said recesses being adapted to receive reinforcement wires cut to the desired length, a movement of rotation being imparted to the tubular element such that for a predetermined inclination of the recess containing a reinforcement wire, the latter escapes from the said recess by gravity.

A split tube arranged above the reinforcement wire feed device is provided for the continuous reception of the reinforcement wires; this split tube comprises a longitudinal slit and is adapted to rotate on its axis so that the longitudinal slit occupies the lower part of the tube when the cut reinforcement wire is intended to drop into the feed device.

The monoblock factory also comprises a mould-stripping installation having a head carried by a connection tube, parallel to the axis of the housing and close to the internal surface of the resistant structure, this tube being situated substantially in the horizontal plane of the axis of the housing, the said tube serving as axis of rotation of the head comprising recesses adapted to receive the cast products; a jack is provided for controlling in combination with a guide device a movement of translation and rotation of the head, the said jack being pivoted by one end to a fixed point of the internal construction of the housing and by its other end to an arm solid with the rotary tubular element.

This mould-stripping installation also comprises pushing means situated on the outside, in the radial direction, with respect to the moulds, comprising fingers adapted to produce a thrust against the concrete products for loosening the said products with respect to the moulds and pushing the products into the recesses of the aforesaid head.

In addition to the arrangements explained in the foregoing, the invention comprises certain other arrangements, which will be dealt with more explicitly in the following in connection with a preferred embodiment, described with reference to the accompanying drawings, but which is by no means restrictive. In these drawings:

FIG. 1 is a cross-section on the line 1—1 of FIG. 2*a* of a monoblock factory according to the invention;

FIG. 2*a* is a longitudinal section of this factory along II*a*—II*a* of FIG. 1;

FIG. 2*b* is a simplified longitudinal section showing the carrier structure and the resistant structure; to facilitate reading of the drawing, the moulds and all adjoining constructions have not been shown;

Figure 13:
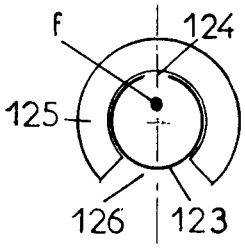
Figure 14:
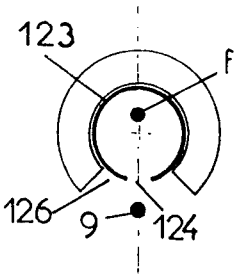
Figure 12:
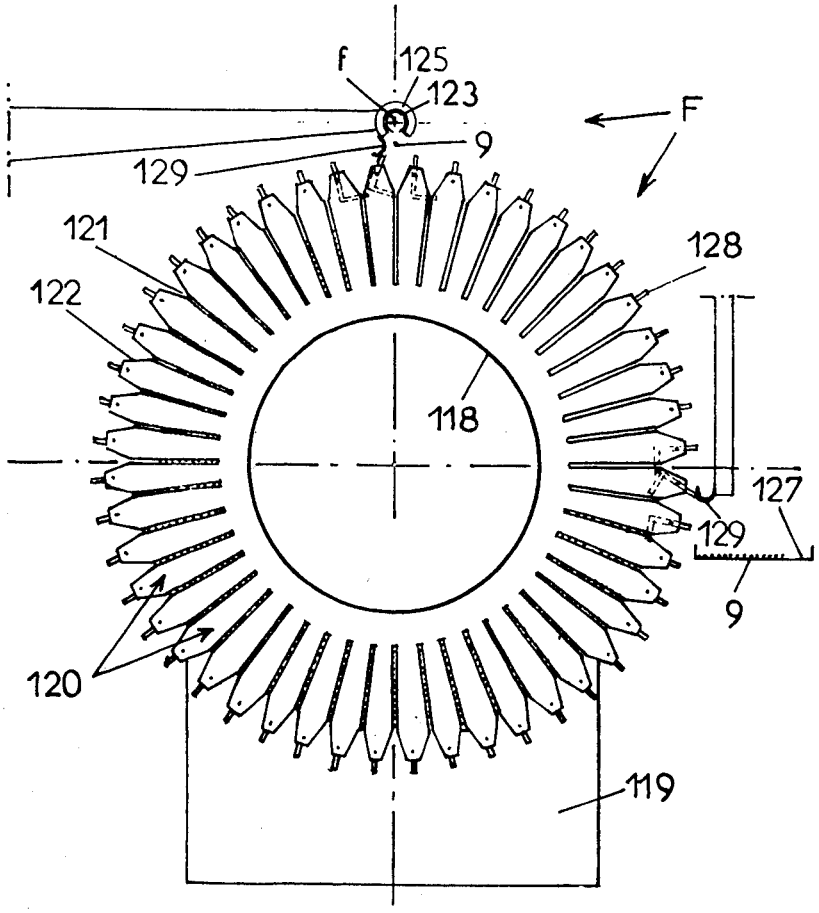
FIG. 12 shows in cross-section the reinforcement-wire feeding device for the concrete products.

FIGS. 13 and 14 finally show on a large scale a detail of FIG. 12 in two different working positions.

Figure 1:
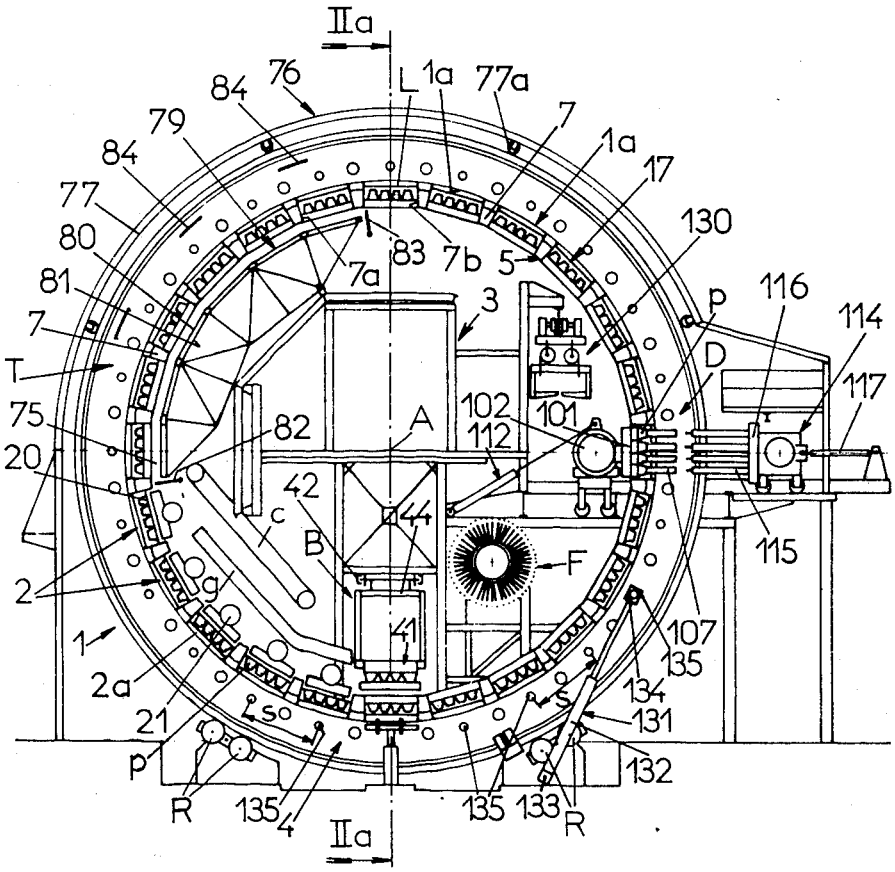

Referring to the drawings, more particularly to FIG. 1, a monoblock factory is shown for the manufacture of products *p* in prestressed concrete; the factory could possibly be used for the manufacture of reinforced concrete products.

This factory comprises a rotary carrier housing 1 of general cylindrical shape with horizontal geometric axis A; the housing 1 is rotatable on its axis A and is supported by rolling means R provided in its lower part and shown diagrammatically.

This housing conveys the moulds 2 (for the products p) placed on the inner surface 1*a* of the housing. Thus, by its rotation, the housing causes the moulds to pass in front of various working stations mounted on a fixed construction 3 arranged in the interior of the housing and passing axially through the latter.

These working stations comprise a concreting installation B, a heat-treatment installation T, a mould-stripping and removing installation D and a wire-feeding installation F.

The rotary housing 1 comprises a circular carrier structure 4 supported by rolling means R and a structure 5 for resistance to longitudinal stresses parallel to the axis A. The resistant structure 5 is arranged in the interior, in the radial direction, of the carrier structure 4 and is fixed to the latter (FIG. 2*b*).

Figure 2A:
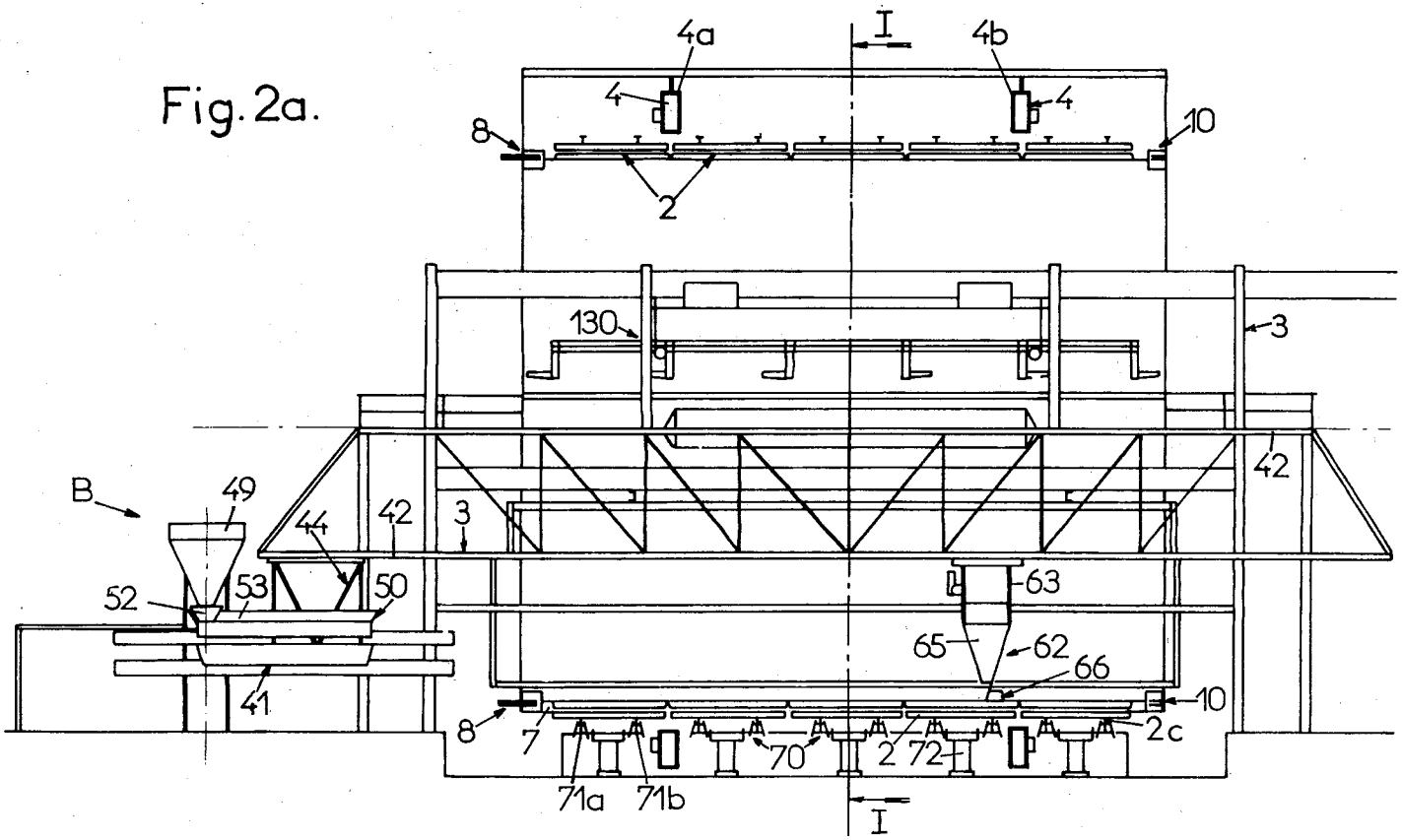
Figure 2B:
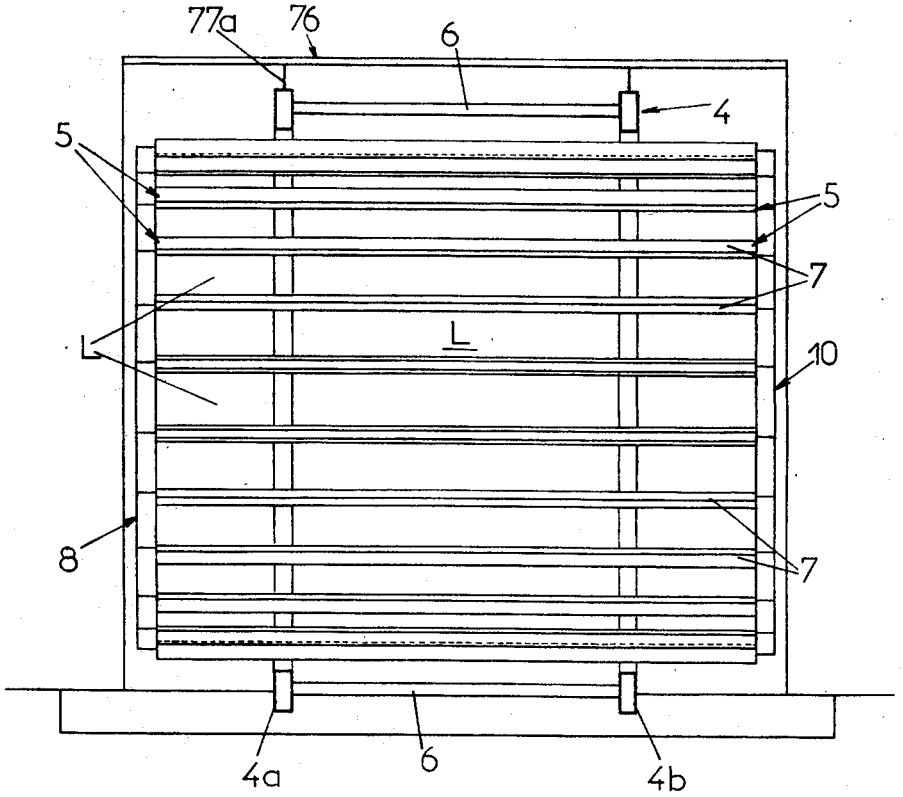

The carrier structure 4 comprises at each longitudinal end circular rings 4*a*, 4*b* of rectangular hollow cross-section (see FIGS. 2*a*, 2*b*).

Each ring 4*a*, 4*b* rolls on means R supporting the structure 4. The two rings 4*a*, 4*b* are connected rigidly to one another by longitudinal elements 6 (FIG. 2*b*) in particular tubular elements, parallel to the axis A, such that the structure 4 has a squirrel-cage shape. This structure 4 is situated in the middle part of the installation as shown in FIG. 2*b* and the resistant structure 5 projects axially at both ends from the carrier structure 4.

The resistant structure 5 comprises longitudinal girders 7 parallel to the axis A, arranged in the interior radially of the carrier structure 4 and fixed to the rings 4*a*, 4*b*, in particular welded to them (FIG. 2*b*).

These longitudinal girders 7 are spaced apart regularly over a complete circumference so as to form between them longitudinal recesses L for the sets of moulds 2 arranged in sequence one after the other as shown in FIGS. 1, 2*a* and 2*b*.

In the example shown in the drawings, there are 24 recesses L distributed over the entire internal periphery of the structure 4. The number of the recesses may be different and may be selected as a function of the duration of the production cycle of a concrete product.

As shown in FIGS. 2*a*, 2*b*, 3, 4, 5 and 6, the resistant structure 5 comprises at one longitudinal end means 8 for the attachment of the reinforcing wires 9 of the concrete products *p* and at its other longitudinal end means 10 for tensioning the reinforcing wires 9, such that the tensile stresses on these wires are taken up exclusively by the structure 5, i.e. by the girders 7.

Figure 10:
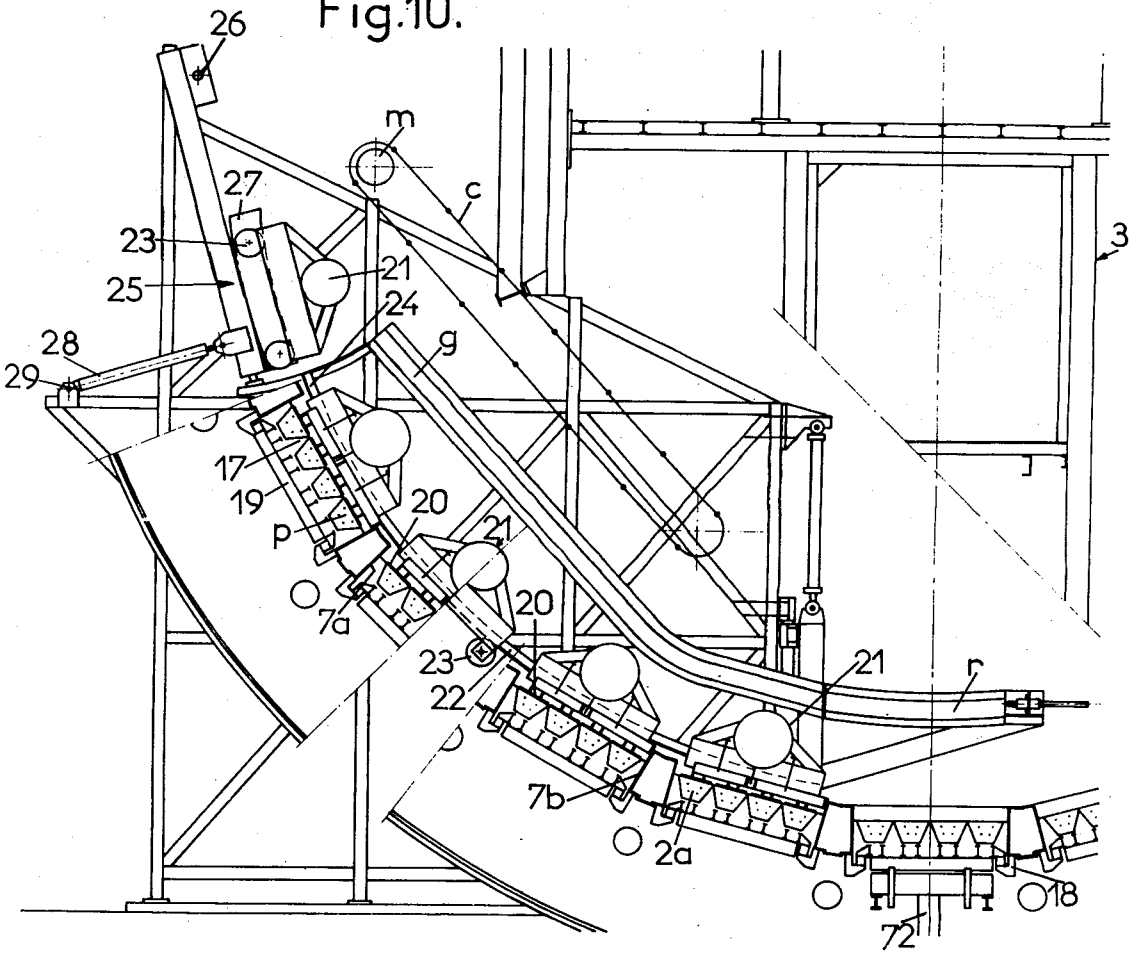
FIG. 10 is a part section showing the portion of the path of the moulds during which the covers are on the moulds, as well as the means for returning the covers to the lower part of the housing.

These girders 7 are in particular formed by two U-shaped girders, which are turned with their concavities facing each other and are rigidly connected together, have a hollow cross-section bounded by a polygonal outline in the form of an isosceles trapezoid, the small base of which is turned towards the axis of rotation of the rotary housing, as is shown clearly in FIGS. 1 and 10. The walls *7a, 7b* of the two successive girders 7, as shown in FIG. 10, are parallel to the longitudinal plane passing through the axis A and equidistant from the girders 7; it is thus possible to introduce or to withdraw from between the wall *7a* and *7b* the sets of moulds 2 by a radial movement.

Figure 3:
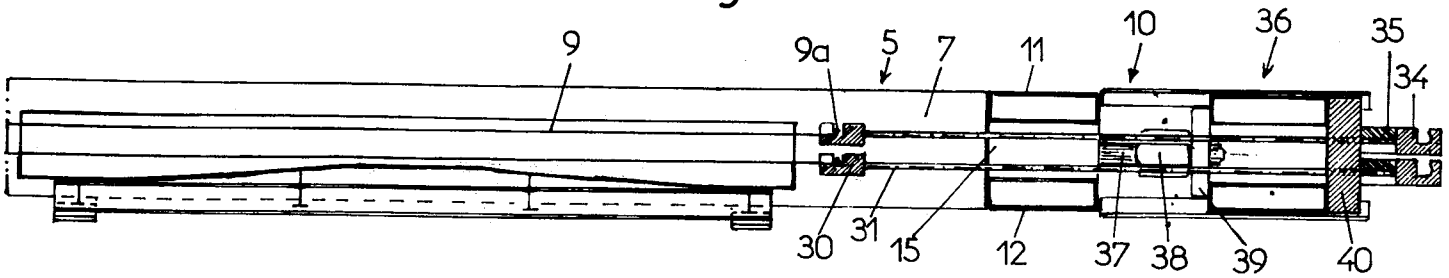
FIG. 3 is a part longitudinal section showing one end of the longitudinal girders provided with means for putting the reinforcement wires to tension, with a device for progressive reduction of the tension, comprising a screw and nut system.
Figure 4:
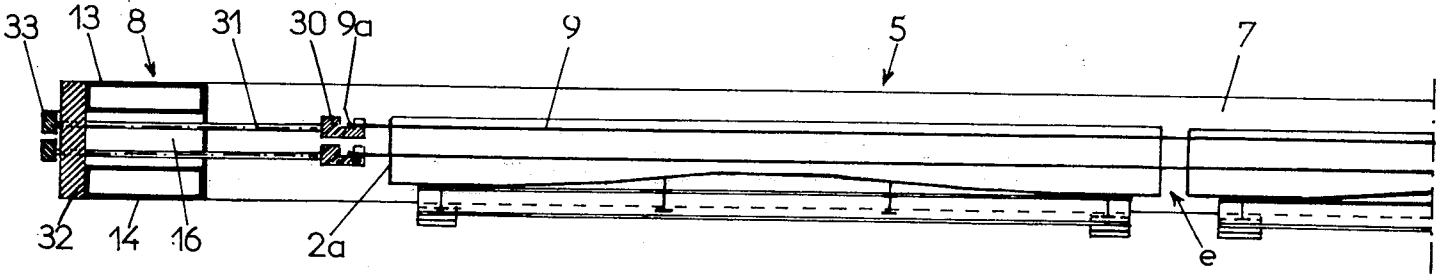
FIG. 4 shows the other end of the longitudinal girders and the row of moulds corresponding to FIG. 3.

The girders 7 may be connected together at their longitudinal ends (as shown in FIGS. 3 and 4), by transverse ties 11, 12, 13, 14 spaced radially from one another so as to leave free a radial space 15, 16 for the passage of the pulling or tensioning means 10 and attachment means 8.

These ties are formed particularly by elements having a hollow section of rectangular shape; the long side of this section is oriented parallel to the direction of pull of the reinforcement wires such that the moment of inertia will be the strongest possible in that direction. The whole of the ties situated in the same plane form a regular polygon, the number of sides of which correspond to the number of recesses L provided in the installation.

The means for moulding concrete products comprise sets 2 of unit moulds *2a*. The unit mould *2a* is denoted as a mould whereby it is possible to manufacture a product such as a railway sleeper or a post, etc.

Figures 5, 6:
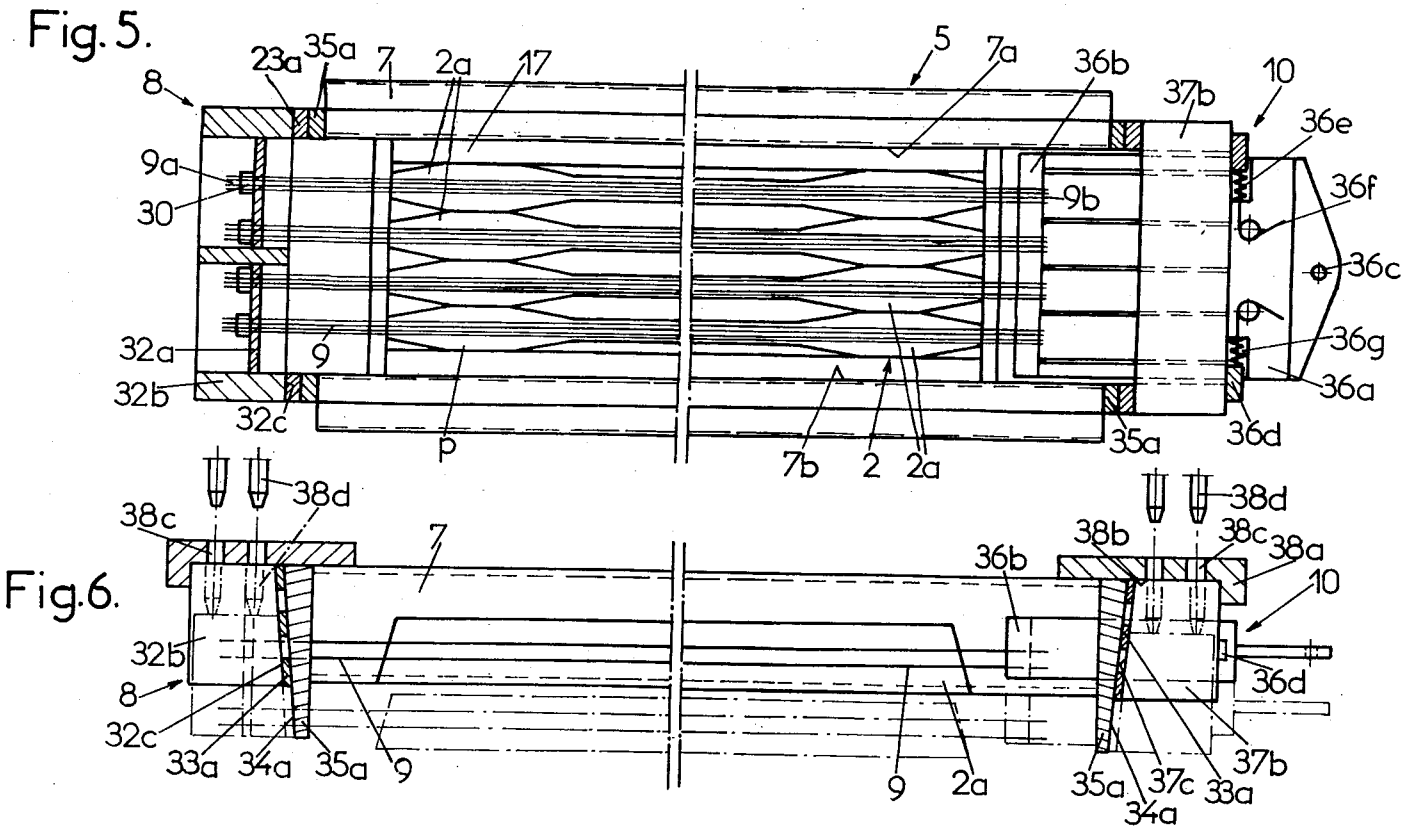
FIG. 5 shows in plan a row of moulds arranged between two longitudinal girders of the housing, provided with a progressive tension-reducing device, comprising a head for pulling all the reinforcements of one and the same row of moulds and a system of two wedges, the slopes of which are opposite.
FIG. 6 is a longitudinal cross-sectional view of the arrangement shown in FIG. 5.

A number of unit moulds arranged side by side on their longitudinal edges and included between two end planes perpendicular to their longitudinal direction are assembled in a set 2, the width of which is substantially equal, but slightly less than the width of the available space between two faces *7a, 7b* of successive girders 7 (see FIG. 5).

These unit moulds *2a* are assembled so as to form a shell 17 (FIG. 10).

The shell 17 is fixed to a mechanically strong framework 19 and forms an assembly of shaped sections, in particular I-shaped. Fixing of the shell to the framework is preferably one that can be taken to pieces, for example by means of bolts and nuts.

The frameworks 19 are mounted on supports 18 fixed to the girders 7 (FIGS. 7 and 10), with the possibility of longitudinal sliding parallel to the axis A.

Figure 7:
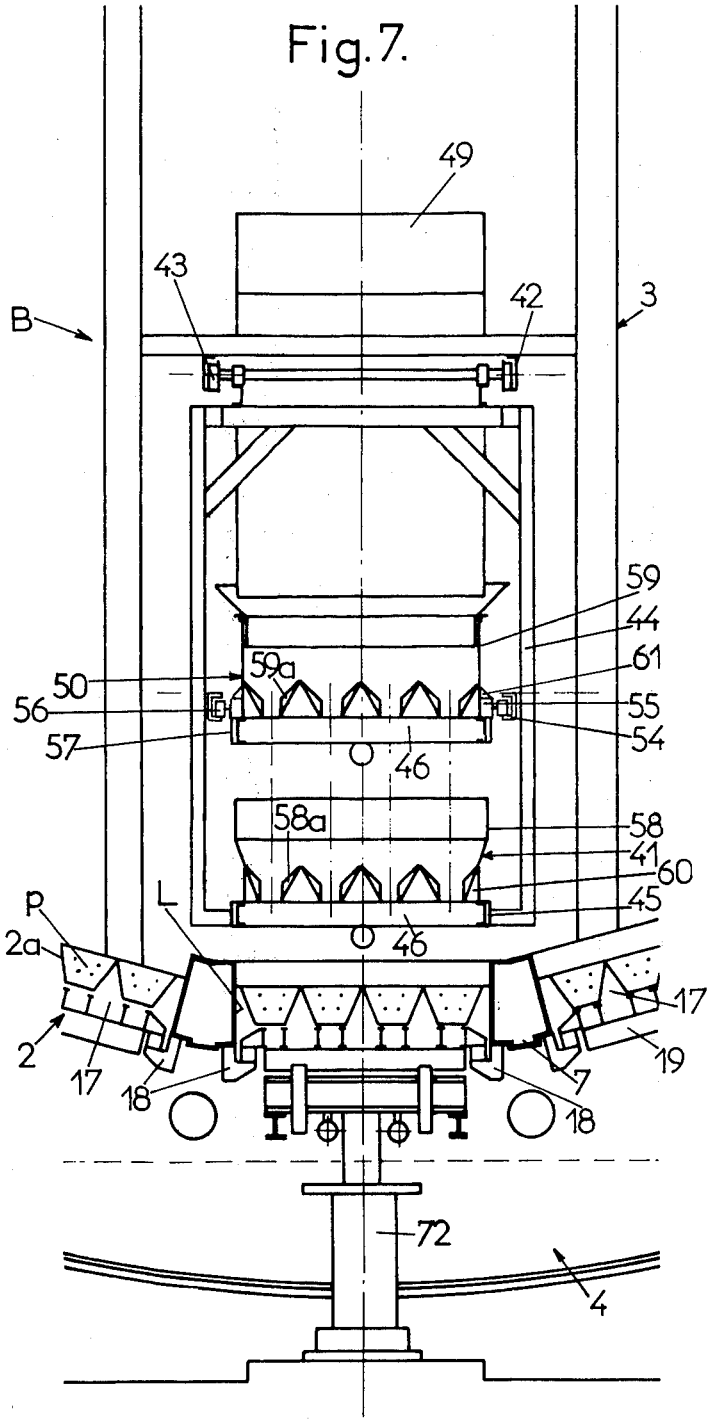
FIG. 7 is a part view in elevation, with parts broken away, of the concrete pouring installation.

The shell 17 is open on the side opposite the framework, that is to say when a set of moulds 2 is in position between two girders 7, the open face of the shell 17 is turned towards the axis A, as shown in FIGS. 1, 7 and 10 in particular, such that pouring of the concrete into the moulds is effected by gravity when the moulds are at the low point of the path.

A cover 20 (FIGS. 1 and 10) is provided for closing each set of moulds after pouring the concrete.

As shown particularly in FIG. 10, the covers of a line of moulds comprised between two longitudinal girders 7 are carried by supporting element 21 of tubular form, extending along the entire axial length of the installation. The covers 20 rest on the surface of the concrete contained in the moulds. As shown in FIG. 10, the said covers may be formed of simple plates, preferably supported through resilient means by the supporting element 21.

The covers 20 are held on the unit moulds *2a* by a rail 22 of a circular arc shape (FIG. 10) provided at each longitudinal end of the factory. The said rail 22 bears against rollers 23 carried by the ends of the supporting element 21.

In FIG. 10, part of a shell 17 has been broken away to show the end of the supporting element 21 provided with rollers 23; this end provided with the roller 23, and the rail 22 are situated behind the plane of section of FIG. 10.

The covers 20 rest on the moulds on part of the circular path, in particular only on a part extending substantially along a quarter of a circle, as shown in FIG. 10. In fact, the covers are placed on the mould in the lower part of the path and are withdrawn from the moulds at slightly less than 45° with respect to the bottom point as shown in FIG. 10.

Means are provided for taking over the covers 20 and the supporting element 21 when the concrete in the moulds has set sufficiently, and for ensuring the return of the said covers and supporting element 17 in the lower part of the path of the moulds.

These take-over means comprise at the top end 24 (FIG. 10) of the circular-arc rail 22 a gripping element 25 pivotally mounted on a pin 26 and provided with a rail 27 adapted to receive the rollers 23 with which each end of the supporting element 21 is provided. Such a device 25 is provided at each axial end of the housing. Means (not shown) are provided for locking the rollers 23 in the rail 27 and for maintaining the supporting element 21 on the gripping element 25. These clamping means may be in the form for example of jacks ensuring the locking of the rollers 23 in the rail 27.

Pivoting of the gripping element 25 on its pin 26 is controlled by a jack 28, the end of whose rod is pivoted to the gripping element 25, while the end of the cylinder is pivoted to a fixed point 29.

A guide track *g* for the return of the supporting element 21 and the covers 20 towards the lower part of the path is also provided; the said guide track *g*, as shown in FIG. 10, is situated towards the interior, in the radial direction, in relation to the girders 7. The gripping element 25 is adapted to place the rail 27 in the extension of the end 24 of the rail 22 such that the ends of the supporting element 21 can be engaged in the said rail 27. The supporting element 21 is then locked in this gripping element 25. The jack 28 can then control, by the outward movement of its rod, rotation of the gripping element 25 in an anticlockwise direction until the rail 27 comes into line with the return track *g*.

In this position, a chain device *c*, driven by a motor *m*, is provided to take charge of the ends of the supporting element 21. This chain *c* is provided with means (not shown in detail) adapted to ensure the attachment of the ends of the supporting element 21. Taking over of the supporting element 21 by the cain *c* is accompanied by the liberation of the said supporting element 21 in respect of the gripping element 25.

A chain *c* is provided at each axial end of the factory, synchronization of the movement of these chains 31 being ensured. The supporting element 21 and the covers 20 thus return to the bottom point of the path along the guide track *g*.

Having arrived at the bottom point of the path, the rollers 23 are received in a part of the rail *r* (FIG. 10) carried by means, particularly hydraulic jacks, adapted to ensure a vertical displacement of the said rail *r* for applying the covers 20 and the supporting element 21 to the concrete in the moulds.

The supporting element is then driven by rotation of the factory, such that the rollers 23 again arrive against the rail 22, the rollers 23 being situated on the outside, in the radial direction, with respect to the said rail 22.

As shown in the drawings, in the example represented, each set of moulds comprises four unit moulds 2*a*, arranged side by side transversely. In the recesses L formed between two girders 7 several sets of moulds are placed one after the other.

During moulding, a reinforcement wire 9 passes through all the unit moulds aligned between two girders 7, as shown in the drawings, the transverse ends of the moulds 2*a* comprising holes for the passage of the reinforcement wires 9.

The manner of mounting the sets of moulds 2 on the girders 7 is selected in accordance with the shape of the products to be manufactured.

FIGS. 2*a*, 2*b* (left-hand part) and especially FIGS. 4 and 6 show the attachment means 8 of the reinforcement wires 9 in the installation according to the invention.

The attachment means 8 comprise attachment elements 30 adapted to receive the end 9*a* of the reinforcements 9 and to retain the said end longitudinally when a tension is exerted on the reinforcement 9. In the case of FIGS. 4 and 5, each element 30 is mounted on the end of a rod 31 passing through the free space 16 provided between the ties 13 and 14. The rods 31 also pass through a plate 32 supported against the said ties 13 and 14 on the side opposite to sets of moulds 2. The rods 31 comprise detachable heads 33 provided on the side of the plate 32 opposite the ties 13 and 14 such that the tension on the reinforcement 9 is transmitted by the said heads 33 to the plate 32 and to the ties 13 and 14.

The tensioning means 10 of the reinforcements 9 are illustrated more particularly in FIG. 3, showing the elements 30 for attaching the ends 9*a* of the reinforcements 9, the said elements 30 being connected by rods 31 passing through the free space 15 between the ties 11 and 12 and having heads 34 adapted in conventional manner to permit a tension to be exerted on the rods 31 and on the reinforcements 9 by means of a hydraulic jack, not shown. When the tension is exerted by the jack, elongation of the reinforcements 9 is produced, such that a longitudinal movement of the heads 34 is produced with respect to the abutment wall against which the jack is supported. Conventional chocks or wedges 35 are then inserted between the heads 34 and the abutment wall against which the jack bears for maintaining the tension on the reinforcements 9 in the absence of the jack.

The tensioning means 10 are so adapted that at the end of the operation of fabricating the concrete products, they permit a gradual reduction in the pulling force applied to the reinforcements 9.

For this purpose, stop means 36 are provided, whose longitudinal position with respect to the ties 11 and 12 is continuously adjustable by means of device comprising a screw 37 and nut 38.

The screw 37 is fixed at the end of the girders 7 on the ties 11 and 12 so as to project to the outside on the said ties and extend in the longitudinal direction of the girders 7. The nut 38 mounted on the said screw acts as retention member for the stop means 36.

The said stop means 36 comprise a rigid frame adapted to slide longitudinally and having a free internal space for the passage of the rods 31. This frame is held by a plate 39 supported against the nut 38. Another plate 40 is provided on the side of the frame opposite the nut 38. The said plate 40 is adapted to serve as stop for the chocks 35 for transmitting to the frame 36 the pulling force on the reinforcements 9. This force is thus transmitted by the plate 39, nut 38, rod 37 to the ties 11 and 12 and to the griders 7.

During tensioning of the reinforcements by means of the hydraulic jack, the nut 38 is at the maximum distance from the ties 11 and 12, such that at the end of the fabricating operation, by screwing the nut so as to cause it to approach the ties 11 and 12, the pull on the reinforcements 9 is gradually reduced. The amplitude of the possible travel of the nut 38 is greater than the sum of the elongations of the parts of the reinforcements 9 passing through the free spaces *e* included between the sets of successive moulds.

FIGS. 5 and 6 show a modified embodiment of the tensioning means 10 adapted to permit, at the end of the operation of fabricating the concrete products, a gradual reduction in the pulling force applied to the reinforcements 9.

In the left-hand part of FIG. 5, it may be seen that the attachment parts 30 bear against a plate 32*a* integral with a frame 32*b*. The reinforcements 9 pass through openings provided in the plate 32*a*. The face 32*c* (FIG. 6) of the frame is inclined with respect to a plane perpendicular to the horizontal axis A of the factory. The said face 32*c* bears by means of an intermediate plate 33*a* of constant thickness against the inclined face 34*a* of a part 35*a*, which, by means of a face 34*b* situated in a plane perpendicular to the axis A bears against the end of two successive longitudinal girders 7. The cross-section of the part 35*a*, as shown in FIG. 6, has the form of a wedge, the slope of which is to some extent inverted with respect to the wedge formed by the frame 32*b*. In fact, on moving along the axis of the factory, the dimension of the wedge 35*b*, regarded radially, gradually increases in the direction of the said axis A, as shown in FIG. 6, while the dimension of the part 35*a* gradually diminishes if one moves in the same direction.

The part 35*a* has the form of a frame surrounding an opening for the passage of the reinforcements 9.

The tensioning device, shown in FIGS. 5 and 6 comprises, at the other end of the reinforcements 9, a head 36*a* formed by a part having a rectangular contour, as shown in FIG. 5, comprising a reinforced edge 36*b* comprising passages for the ends 9*b* of the reinforcements; the said ends 9*b* are attached to the said edge 36*b*. The head 35*a* thus permits a simultaneous pull to be exerted on all the reinforcements 9 of the unit-moulds 2*a* situated between two girders 7. A hole 36*c* is provided in the head 36*a* for exerting by means of a jack, not shown, a pull on the said head 36*a*. The reaction of the stress exerted on the head 36*a* is taken up by the longitudinal girders 7.

The head 36*a* passes through a frame 37*b* similar to the frame 32*b*. The frame 37*b* also comprises an inclined face, similar to the face 32*c*. A plate 33*a* and a part 35*a* similar to that situated on the left-hand side of FIGS. 5 and 6, are provided between the face 37*c* and the end of the girders 7.

The said girders 7 comprise, at each longitudinal end, plates 38*a* fixed to the girders 7, comprising a recess 38*b* adapted to serve as recess for a part of the frame 37b, as shown in FIG. 6.

Holes 38c are provided for the passage of thrust fingers 38d (FIG. 6).

The pulling head 36a comprises transverse bolts 36d urged outwardly by springs 36e. Rotary elements 36f (FIG. 5) enable a pull to be exerted, by means of a cable, on the bolts 36d for their removal into recesses 36g against the action of springs 36e.

For putting the reinforcements under tension, with the device shown in FIGS. 5 and 6, the frames 32b and 37b are situated in the position shown in FIG. 6 in solid lines.

The reinforcements 9 are placed in position in the moulds 2a and are locked by their ends 9a on the plate 32a.

The pulling head 36a is moved from the right towards the left, in FIG. 5, by withdrawal of the bolts 36d, such that the head 36a is able to slide into the interior of the frame 37b.

The ends 9b can thus cross the edge 36b of the head 36a; the said ends 9b are fixed to the edge 36b.

Then by means of a hydraulic jack, a pulling force is exerted on the head 36a, the jack being coupled to the head 36a by means of a pin engaged in the hole 36c.

The pulling force of the jack produces a movement of the head 36a from left to right of FIG. 5, until the bolts 36d exit on the right of the frame 37b. At this moment, the bolts 36d, urged by the springs 36e, again project towards the outside and bear against the edge of the frame 37b. The reinforcements 9 are subjected to an elongation corresponding to the displacement of the head 36a.

The pulling jack of the head 36a can then be uncoupled since the bolts 36d ensure that the head 36a is held in the pulling position.

When the fabrication cycle of a prestressed concrete product is terminated, in the case of the assembly of FIGS. 5 and 6, stripping of all the elements included between two successive longitudinal girders 7 is commenced. This stripping is obtained by pushing radially inward the prestressed concrete elements and their reinforcements which extend in a continuous manner from the end 9a to the end 9b. In FIG. 6, the mould-stripping position is shown in chain lines.

During this stripping operation, the fingers 38d are moved by appropriate means so as to pass through the holes 38c and push the frames 32b and 37b to the interior of the rotary housing, in the direction towards the axis A of the said housing.

During this radial movement, the frames 32 b and 37b are urged by the tensioned reinforcements 9 to remain in contact with the ties 33a, which themselves bear against the faces 34a of the parts 35a.

According to FIG. 6, it will thus be seen that the spacing between the faces 32c and 37c of the frames 32b and 37b, during the radial stripping movement, towards the axis A of the housing, gradually diminishes because of the inverted slopes of the wedges 32b and 35a on the one hand, and 37b and 35a on the other hand. The result is a gradual reduction in the tension of the reinforcements 9.

Referring to FIGS. 1, 2a, 7 and 8, the installation B for pouring the concrete into the moulds may be seen.

This installation comprises a transport truck 41 adapted to move on horizontal longitudinal guide means, for example U girders 42, on which run rollers 43, from which is suspended a frame 44 carrying the truck 41.

The said frame carries in its lower part horizontal girders 45, in particular U girders, supporting the bottom of the truck 41.

This bottom is formed of two shutters adapted to slide in the girders 45 (FIG. 7), such that horizontal sliding of the said shutters 46, 47 is possible to ensure complete opening of the bottom of the truck. A symmetrical elongation device 48 is provided for opening the bottom of the said truck. In the closed position, the shutters 46 and 47 are supported against each other at half-way along the length of the truck 41. The device 48 may comprise two jacks, as shown in FIG. 8.

Figure 8:
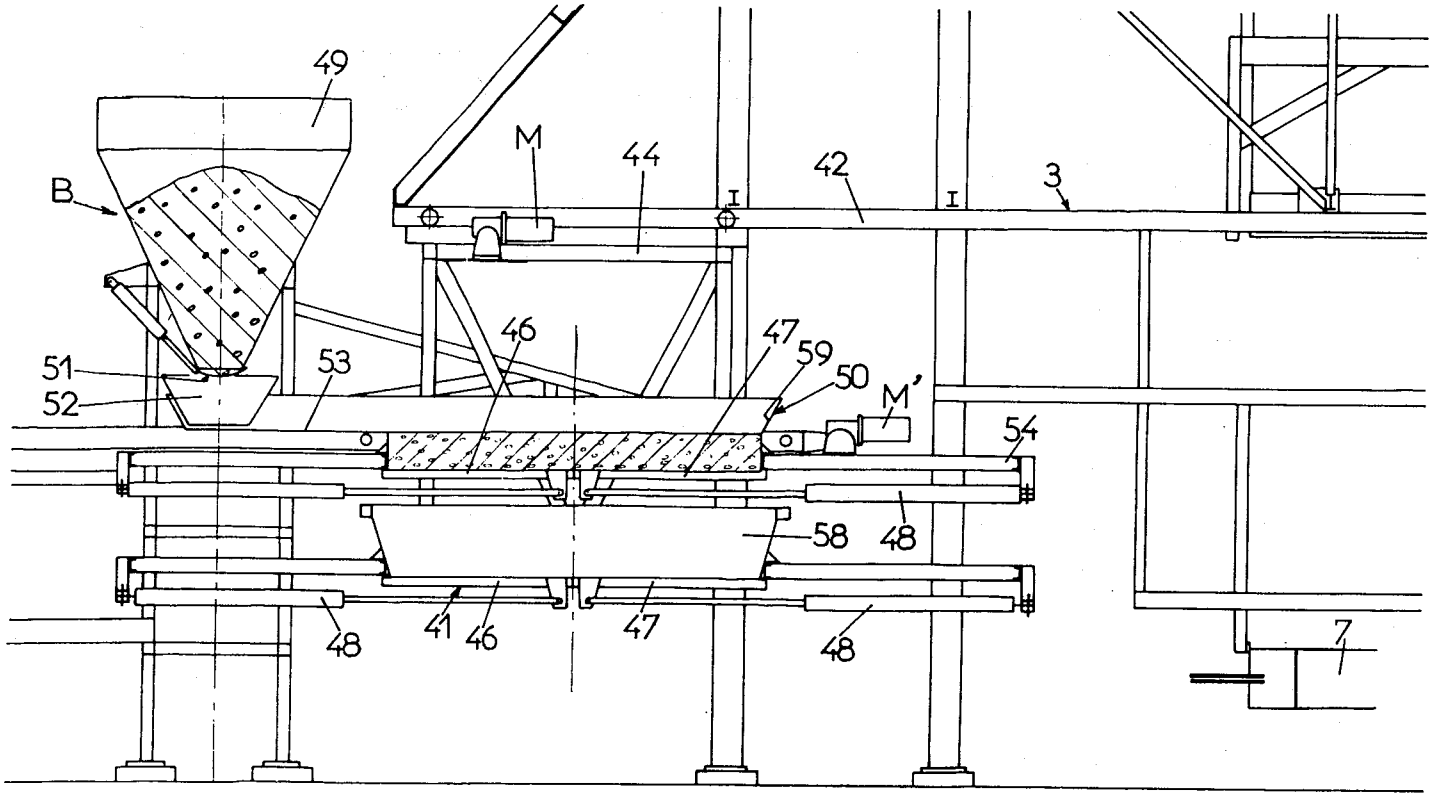
FIG. 8 is a longitudinal section of the concrete pouring installation showing in particular the feed truck and the transport truck.

The guide means 42 pass through the rotary housing such that the truck 41 may be brought above any set of moulds when they are in the low position of its path; the said guide means 42 also extend to the outside of the housing as far as the bin 49 containing the concrete (FIGS. 8 and 2a).

A feed truck 50 is provided for ensuring the transfer of the concrete between the bin 49 and the transport truck 41. The feed truck 50 is situated outside the rotary housing in the longitudinal direction and comprises a bottom formed by shutters, identical with the shutters 46 and 47 and denoted by the same references as in FIG. 8.

The bin 49 comprises in its lower part a rotary shutter closure device 51. A buffer bin 52 is arranged under the bin 49 between the latter and the feed truck 50, so as to be able to preserve the excess concrete running from the bin 49.

The truck 50 comprises, on its left-hand side in FIG. 8, in its upper part, a plate 53, forming a shutter sliding under the bin 52 and adapted to close the said bin when the truck 50 has moved away to the right in FIG. 8 beyond the zone of the bin 52.

The said truck 50 is guided by guide means or girders 54 formed for example of U girders. The mounting of the truck 50 is similar to that of the truck 41 with a frame 55 supported by rollers 56 running in the girders 54. The said frame 55 itself supports guide girders 57 supporting the sliding shutters 46, 47 forming the bottom of the truck 50.

Driving means M, M' are provided for driving the trucks 41 and 50 along the girders 42 and 54.

The truck 41 and truck 50 comprise side walls 58, 59 forming a continuous contour for example in the form of a pyramid, the large base of which is turned upwardly. The dimensions of this contour are so determined that the mix collected by the trucks corresponds to that necessary for filling a set of moulds corresponding to a type of product to be fabricated.

The said walls 58, 59 therefore form a sort of belt resting respectively on the girders 45 and 55, as shown in FIG. 7. For this purpose, the belt 58 comprises laterally triangular iugs 60 supported on the girder 45, while the belt 59 comprises lugs 61 supported on the frame 55. Walls 58a and 59a, shown in FIG. 7, may be provided inside the belts 58 and 59 for defining volumes corresponding to those of the fabricated products.

It will be clear that when the type of product to be fabricated changes, it will merely be necessary simply to change the belts 58 and 59, and replace them by belts appropriate for the type of product to be fabricated. The rest of truck 41 and truck 50, especially the bottom and the movement device, is retained entirely.

Figure 9:
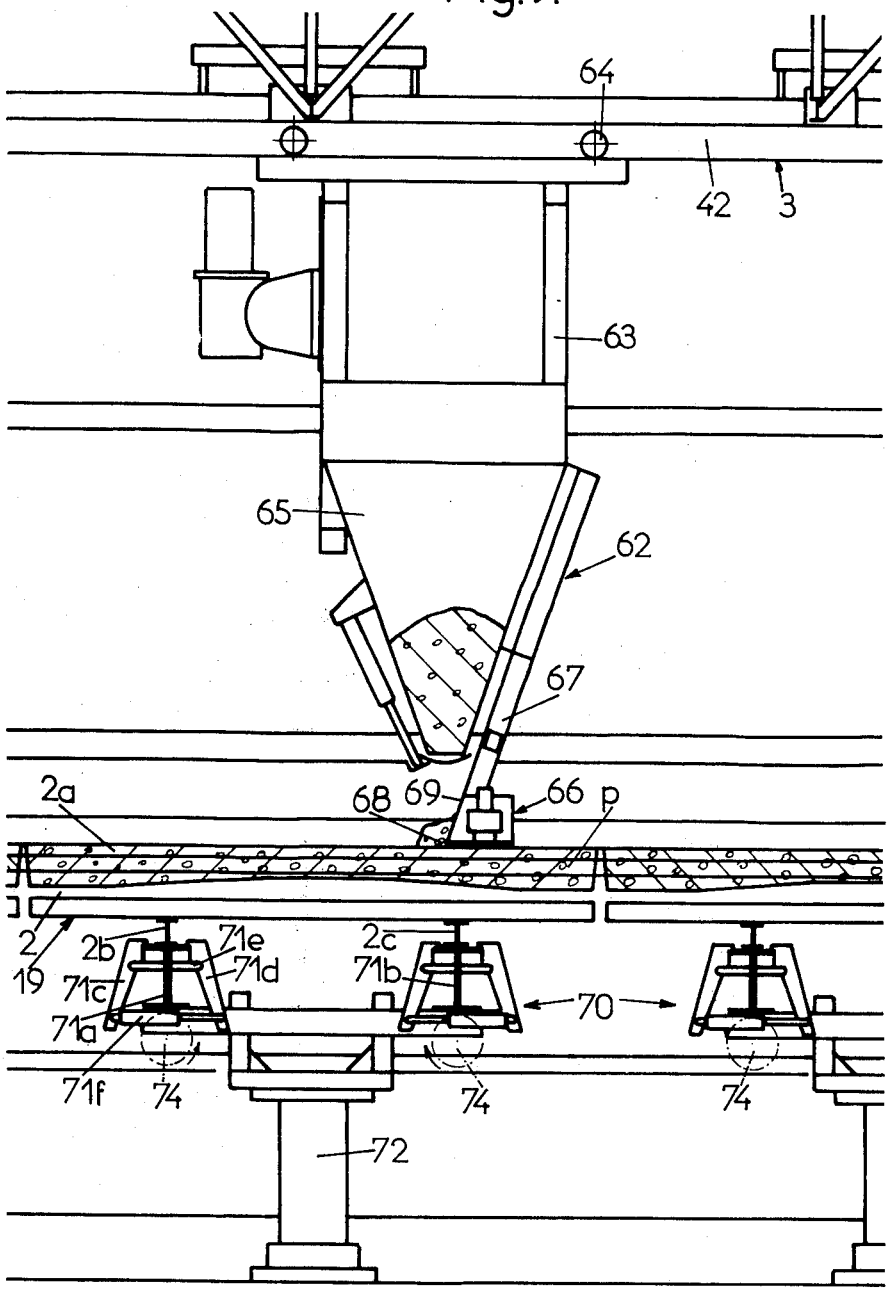
FIG. 9 is a cross-section showing the smoothing device of the concrete-pouring installation.

The concrete pouring installation B comprises a smoothing device 62 (FIG. 9) adapted to move on guide means, in particular the guide means 42 of the transport truck 41. The said smoothing device 62 is situated, when inoperative, on the outside, in the axial direction of the rotary housing on the side opposite the bin 49, the girders 42 projecting from the rotary housing. The said smoothing device comprises a carrying frame 63 adapted to travel by means of rollers 64 on the girders 42. A bin 65 is fixed to the frame 63 and contains concrete to ensure complete filling of the moulds 2*a*. A vibrating head 66 is attached to the bin 65 by means of a device 67 adjusting the vertical position of the said head 66, enabling it to be placed at the appropriate level. The said device 67 in particular permits lifting of the head 66 for crossing an obstacle during the movement in translation of the frame 63. The head 66 comprises a horizontal lower wall adapted to move on the surface of the mould and an end scraper 68 formed by the lower edge of a front wall 69 inclined at an acute angle with the lower horizontal wall of the head 66.

The moulding and concrete pouring installation B also comprises vibration means 70 (FIGS. 8 and 9) of the sets 2 of moulds and moulds 2*a*. This vibration means comprise at least one and preferably two girders 71*a*, 71*b* (FIG. 9) perpendicular to the vertical plane passing through the longitudinal axis of the row of moulds. The said girders 71*a*, 71*b*, having in particular an I cross-section, are supported by lifting means 72 formed by hydraulic jacks with, possibly, interposition of means, such as slabs of elastomer materials adapted to filter the vibrations between the girders 71*a* and 71*b* and the lifting jacks 72. Means 74 are in addition fixed to the girders 71*a* and 71*b* for imparting to them a vibrating movement, these means 74 being conventional means, such as a motor rotating a weight whose center of gravity is eccentric with respect to the axis of rotation of the motor. During the operation pouring concrete into a set of moulds 2, the lifting means 72 situated under this set of moulds bring the girders 71*a*, 71*b* into contact with the bottom of the framework 19 (FIGS. 7 and 9) and the vibration means 74 are set in action, such that the vibrations are transmitted by the girders 71*a*, 71*b* to the moulds 2*a*.

Advantageously, means are provided for ensuring the attachment of the girders 71*a*, 71*b* to the moulds 2*a* for the concrete-vibration operation, so as to transmit the vibrations better to the moulds 2*a*.

These attachment means comprise for each girder, such as 71*a*, clamping arms 71*c*, 71*d*, pivoted in the vicinity of their upper ends, to a support 71*e* fixed to the girder 71*a*. The lower ends of the arms 71*c*, 71*d* are connected together by a jack 71*f*. The admission of fluid under pressure, in particular oil, to this jack 71*f* causes the rod of the jack to be pushed out and the lower ends of the arms 71*c*, 71*d* to move apart, the upper ends of the arms 71*c*, 71*d* are moved towards each other and can exert a clamping force.

The framework 19 for a set of moulds 2 comprises, in its lower part, cross-members 2*b*, 2*c*, in particular of I section. The upper ends of the arms 71*c*, 71*d* are adapted to clamp the horizontal flange of each cross-member 2*b*, 2*c* when the jack 71*f* is fed with pressurized oil. Attachment of beams 71*a*, 71*b* to the set of moulds 2 is thus ensured, such that the transmission of the vibrations produced by the vibrators 74 to the concrete, contained in the moulds 2, is effected under good conditions.

Reference will now be made to FIG. 1 showing the heat-treatment installation T for the concrete products.

This installation extends substantially over a quarter of a circle and commences in the zone 75 situated, in the direction of rotation of the housing, at about 90° after the concrete-pouring station B.

This heat-treatment installation T comprises a fixed heat screen situated outside the housing and extending along a substantially semicylindrical surface. The said heat screen comprises a metal frame 77 and a heat screen proper formed by a sheet of thermally insulating material, in particular a plastics-material sheet, stretched on the framework 77. The framework 77 rests by means of rotary rollers 77*a* on the housing and more particularly on the rings 4*a*, 4*b*.

A second heat screen 79 is provided inside the housing and is formed by a double wall 80, 81 of heat-insulating material. For example, the screen 79 is formed by two sheets of plastics material between which an air cushion is trapped. The said screen 79, as shown in FIG. 1, extends along a polygonal contour or, as a variation, along a circular arc of about 90°.

The space contained between the inner screen 79 and the moulds carried by the internal wall of the rotary housing is closed at both ends radially by movable walls 82, 83, for example flexible walls, adapted to be moved aside.

Heating means are provided between the outer heat screen 76 and the moulds, so as to direct a flow of heat towards these moulds as they pass by.

The said heating means may comprise infrared radiating devices 84, heated by gas or electricity, and directing the flow of heat against the faces of the moulds 2*a* turned radially towards the exterior.

The mould-stripping installation D (FIGS. 1 and 11) comprises a head 101 carried by a hinged tube 102 parallel to the axis of the housing and in the vicinity of the internal surface of the resistant structure. The axis of this tube, as shown in FIG. 1, is situated substantially on the horizontal plane of the axis A of the housing. The said tube 102 is carried, particularly at its two ends, and possibly between its two ends by vertical supporting plates 103 situated in a plane perpendicular to the axis A. The said supporting plates are guided by guide girders 105, in particular U girders. The said girders 105 are horizontal and perpendicular to the axis A. The tube 102 is rotatably mounted on the supporting plates 103.

Figure 11:
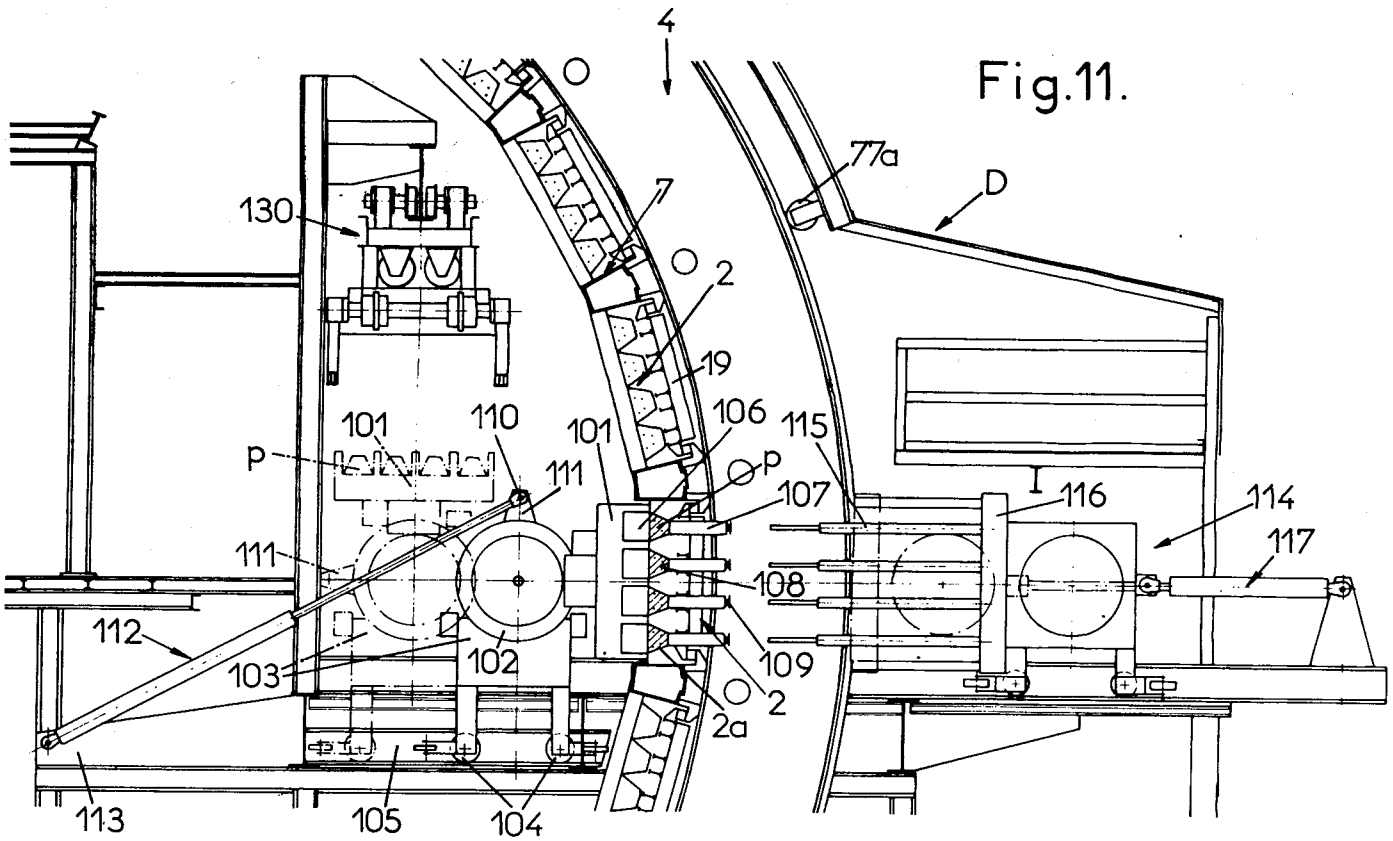
FIG. 11 is a part cross-section showing the means for mould stripping and for the removal of the concrete products.

The head 101 comprises recesses 106 adapted to receive the moulded products p. As shown in FIG. 11, at the moment of stripping, the head 101 is placed vertically, so that the different recesses 106 are arranged one below the other and are situated in front of the products *p*. Thus by a radial translation movement in the horizontal plane of the products *p* from right to left of FIG. 11, the said products *p* will pass the moulds 2*a* in the recesses 106. These recesses extend over the entire length of the girders 7, such that stripping of all the products *p* situated in the moulds between two successive girders is carried out simultaneously. The bottoms of the moulds are traversed by radially disposed cylindrical members 107, mounted for sliding in the moulds. One end 108 of each member 107 is supported against the bottom of the moulded products *p*, while the other end 109 of the member 107 comprises a supporting plate. The members 107 are provided on each set of moulds and are moved, with this set of moulds, during its movement of rotation with the resistant structure and the carrier structure. At the moment of moulding, the members 107 are repelled completely towards the outside, such that their ends 108 are flush with the bottoms of the unit moulds 2*a* and ensure closure of the orifices provided in the bottoms of the moulds to permit sliding of the members 107. For the sake of clarity of illustration members 104 are only shown for the moulds at the mould stripping station.

The tube 102 is provided with a radial extension 111 (FIG. 11) which carries a hinge pin 110 of the end of the rod of a drive jack 112. The end of the cylinder of the said jack remote from the tube 102 is pivoted to a fixed support 113 integral with the fixed construction situated inside the housing.

When the rod of the jack 112 passes from the external position shown in solid lines in FIG. 11 to the internal position, the tube 102 undergoes a combined movement of rotation of a quarter of a revolution in the anti-clockwise direction and of translation along the guide rails 105. The head 101 then occupies the position represented in chain lines in FIG. 11. The opposite movement is produced during the outward movement of the rod of jack 112.

The mould-stripping installation D also comprises thrust means 114 situated externally, in the radial direction, relative to the batteries of moulds 2. These thrust means comprise thrust fingers 115 carried by a head 116 adapted to be moved radially by one or more hydraulic jacks 117.

As shown clearly in FIG. 11, each finger 115 will come into abutment against the end 109 of a member 107 mounted for sliding in the bottom of a unit mould 2*a*.

Eacn finger 115 thus pushes the concrete product *p* and produces the stripping of this product. At least one and preferably more fingers 115 are provided for each unit mould 2*a*. The monoblock factory also comprises an installation F (FIGS. 1 and 12 to 14) for feeding reinforcement wires 9 for the concrete elements.

The said feed device is arranged between the stripping station D and the casting installation B, as shown in FIG. 1, in the interior of the rotary housing. The installation F comprises a tubular element 118 (FIG. 12) provided with two bearings 119 on which are arranged at regular intervals circular crowns 120 provided with radial notches 121 opening on the outer periphery of the crowns in a flared opening on the external periphery of the crowns in a flared aperture 122. As shown in FIG. 12, each crown provided with radial indentations has the appearance of a "daisy".

The different indentations 121 of the successive crowns situated in the same plane passing through the axis of the tubular element 118 such that a straight wire extending along the entire length of the tube 118 may be engaged simutaneously in a notch 121 of the different successive crowns.

The steel wire *f* serving as reinforcement for the concrete elements arrives continuously at the upper part of the device 118, as shown in FIGS. 13 and 14.

The tubular element 118 has its axis parallel to the axis A.

A tube 123 provided with a longitudinal slit 124 (FIGS. 13 and 14) is rotatably mounted in a support 125 of cylindrical form comprising a notch 126 in its lower part.

The said support 125 is integral with the fixed construction provided in the interior of the rotary housing.

The steel wire *f* arrives in the upper part of the internal space of tube 123. The diameter of the said tube 123 is much greater than that of the wire *f*, as is shown in the drawings, being 5 or 6 times greater.

When a length of wire *f* sufficient to form a reinforcement 9 has been introduced into the tube 123, whose slit 124 is in the top position as shown in FIG. 14a, the reinforcement 9 is cut. This reinforcement 9 then drops onto the inner surface of the tube 123.

The wire *f* continues to advance in the upper part of the section of the tube 123.

Rotation of the tube 123 is then controlled such that the slit 124 arrives at the lower part, as shown in FIG. 14, such that the reinforcement wire 9 escapes from the tube 124 and falls by gravity into an opening 122 (FIG. 12) and into the notch 121.

The tubular element 119 having a rotary movement, the reinforcements 9 will be able to escape by gravity from the slits 121 for a suitable inclination of these slits, and will arrive on a plate 127 (FIG. 12) where they may be taken by persons operating the production installation.

The notches 121 may be closed in their upper part by a rocking shutter device 128 co-operating with means 129 adapted to cause the said shutter to rock for opening the end of the notch. These means 129 are provided at the level of the tube 123 ensuring the filling of the notches 121 with reinforcements 9 and at the level of the plate 127 which should be fed by the reinforcements 9 contained in the notches 121.

A discharge device such as indicated at 130 (FIG. 11) is also provided for discharging the finished products after stripping.

Means 131 (FIG. 1) are provided for driving with a movement of rotation the whole of the carrier structure 4 and the resistant structure 5 forming the rotary housing. Advantageously, these means 131 comprise, on each outer side of the rings 4*a*, 4*b* (see FIG. 1) a jack 132 whose cylinder is pivoted in its lower part to a fixed pin 133, and whose end 134 of the rod is equipped with a device (not shown in detail) adapted to seize the lugs 135 distributed on a circumference, on the outer transverse faces of the rings 4*a*, 4*b*. The circular arc *s* separating two successive lugs 135 corresponds to the angular spacing between the longitudinal middle planes of two successive sets of moulds 2. The said arc *s* corresponds to the angular pitch of rotation of the housing controlled by the jack 132. In the position shown in FIG. 1, the rod of the jack 132 is extended and its end 134 has engaged a lug 135. The admission of pressurized liquid to the cylinder of the jack 132 controls the retraction of the rod of the jack, such that the lug 135 engaged by the end 134 is driven downwardly so that it describes the arc *s*. The entire housing therefore rotates with the pitch *s*.

When the lug 135 engaged by the end 134 has moved through the arc *s*, the rings 4*a*, 4*b* are locked for rotation, and the end 134 is disengaged from the lug 135 and the rod of the jack 132 extends again from the cylinder for engaging by its end 134 the lug 135 immediately above. The rotation thus controlled is effected, as shown in FIG. 1, in a clockwise direction for the entire rotary housing.

This being so, the factory functions as follows.

The rotary housing 1 is equipped over its entire internal surface with sets of moulds 2 corresponding to the products to be fabricated; the moulds represented in FIGS. 5 and 6 correspond to a particular type of railway sleeper made of prestressed concrete. The housing 1 is set in stepped rotation about its axis A in a clockwise direction looking at FIG. 1.

When a set of empty moulds 2 arrives in the vicinity of the installation F for feeding steel wire reinforcements 9, the said reinforcements are placed in position in the moulds by the factory hands. It is recalled that a reinforcement 9 extends over the entire length of the housing and passes through a number of successive moulds.

After the reinforcements have been placed in position, the next step is to subject them to tension by means of the devices described with reference to FIGS. 3 and 4 or FIGS. 5 and 6.

If the tensioning device of FIGS. 3 and 4 is used, the nut 38 is moved away to the maximum extent of the ties 11 and 12 during tensioning.

If the tensioning device of FIGS. 5 and 6 is used, the frames 32*b* and 37*b* are disposed in the cavities 38*b* serving as recesses (solid line position shown in FIG. 6).

The set 2 of empty moulds equipped with steel reinforcements then arrives at the casting station B, in the lower part of its circular path.

During the time in which this set 2 is stationed in this position, filling of the moulds with concrete is ensured by means of the transport truck 41. The feed truck 50 is filled from the bin 49 while the truck 41 moves along the entire row of moulds to effect the filling of successive sets. The presence of the feed truck 50 permits time to be gained since the duration of filling the feed truck 50, from the bin 49, does not delay the operations. The filling of the transport truck 41 from the feed truck 50, by complete opening of the bottom of truck 50, is very rapid.

The moulds, while being filled with concrete, are set in vibration by the means 70 (shown in FIG. 9) which are attached, below the said moulds, to the elements 2*b*, 2*c*. Smoothing of the upper part of the moulds 2 is ensured by the device 62, clearly visible in FIG. 9.

When filling of the moulds is completed, a tubular element 21 carrying the covers for each unit mould is placed in position on the sets of moulds of the same row situated between two girders 7. This positioning of the tubular element 21 is ensured by the part of rail *r* (FIG. 10) in which are situated the rollers 21 provided on the ends of the tubular element 21; this part *r* is lowered vertically so that the covers 20 come to rest on the surface of the concrete contained in each unit mould 2*a*.

All the preceding operations are carried out automatically while the rotation of the housing 1 has been temporarily stopped.

When these operations are terminated, the housing 1 resumes its rotation by one step, such that the tubular element 21, driven by the radial faces of the girders 7, co-operates by means of its end rollers 23 with the outer surface of rail 22 (FIG. 10).

The sets of moulds thus continue their forward movement, with the covers 20 held by the rail 22 as far as the upper end of 24 (FIG. 10) of the said rail. Setting of the concrete is then sufficient for the covers 20 to be removed. As previously explained, the tubular element 21 then returns, owing to the guidetrack *q* and the driving means *c*, to the lower part of the circular path of the moulds.

The sets of moulds 2 containing the concrete products continue their forward movement and enter the heat-treatment zone T.

The sets of moulds 2 finally arrive at the stripping station D (FIGS. 1 and 11).

In the case where tensioning of the reinforcements 9 has been carried out by means of a device such as that shown in FIGS. 3 and 4, a gradual reduction in tension is carried out by screwing the nut 38 on the screw 37 so as to cause it to approach the ties 11 and 12, which produces sliding of the whole of the sets of moulds with respect to the longitudinal girders 7. It is in fact recalled that these sets of moulds 2 are mounted with the possibility of longitudinal sliding with respect to the girders 7. When the tension of the portions of reinforcements situated outside the concrete elements is suppressed, it is possible to proceed to stripping properly so-called by exerting by the aid of push means 114, thrusting of the elements *p* towards the recesses 106 (FIG. 11).

In the case where the tensioning means are those of FIGS. 5 and 6, stripping of the concrete elements *p* and gradual reduction in the tension are carried out simultaneously, as described in the following.

The push means 114 control the movement of fingers 115 (FIG. 11) exerting a thrust on the elements *p*, and fingers 38*d* (FIG. 6) adapted to move the frames 32*b* and 37*b*.

The radial movement towards the interior of the housing of the frames 32*b* and 37*b* is accompanied by the gradual reduction of the tension of the parts of the reinforcements 9 situated outside the concrete elements, due to the co-operation, on the one hand, of the inclined surfaces 32*c* and 34*a* and, on the other hand, of the the inclined surfaces 37*c* and 34*a*.

It thus appears that in the case of the modification of FIGS. 5 and 6, stripping and gradual reduction in tension of the reinforcements 9 are produced simultaneously.

In the case of the modification of FIGS. 5 and 6, the sets of moulds 2 are also mounted, between the girders 7, with possibility of sliding in the longitudinal direction of the said girders 7.

It is clear that the portions of the reinforcements buried in the concrete products remain under tension, this tension being taken up by the concrete product itself.

The products *p* recovered in the recesses 106 of the head 101 (FIG. 11) are then discharged by means 130. It will be noted that the reinforcements 9 remain in a single piece, with the result that several aligned products *p* are discharged, connected together by the uncut reinforcements.

The reinforcements are then cut, between each product *p*, such that finished products are obtained.

It is clear that the monoblock factory comprises all the conventional control and synchronization means necessary for ensuring the development of the operations explained in the foregoing.

The monoblock factory according to the invention is simple in operation and has a high output, and enables quality products to be obtained under good operating conditions.

I claim:

1. A monoblock factory or installation for the manufacture of concrete products, in particular prestressed and/or reinforced concrete products, comprising a rotary supporting housing of a general cylindrical shape having a horizontal axis of rotation, a plurality of working stations mounted on a construction disposed in the interior of said housing, and a plurality of conveying moulds, for the concrete products, disposed on the internal surface of said housing so as to cause these moulds to pass in front of various of said working stations, the said working stations comprising a concrete-casting installation, a heat-treatment installation and a mould-stripping and manufactured products discharge installation, said factory being characterized in that the rotary housing comprises a rotatable circular carrier structure having a horizontal axis and supported by means permitting the rotation of the said carrier structure on its axis, means for rotating said carrier structure and means resistant to longitudinal stresses in a direction parallel to the axis of rotation of the carrier structure, said resistant means being disposed radially inwardly of the carrier structure toward the axis of rotation and being fixed to the carrier structure, and comprising elongate longitudinal extending members defining longitudinal recesses extending parallel to the axis of rotation of the carrier structure and provided around the entire internal periphery of the said carrier structure, the said recesses receiving sets of moulds for the products to be manufactured, the said resistant means comprising at one longitudinal end, means for the attachment of reinforcement wires of the concrete products and, at its other longitudinal end, means for tensioning the reinforcement wires, such that the tensile stresses of these wires are taken up exclusively by the aforesaid resistant means.

2. A factory according to claim 1, wherein said means permitting rotation of the carrier structure comprises rolling means and characterized in that the circular carrier structure comprises at both longitudinal ends an annular circular end ring adapted to run on said rolling means, being rigidly connected together by longitudinal tubular elements, the resistant means projecting on either side of the aforesaid carrier structure.

3. A factory according to claim 1, characterized in that said elongate members comprise longitudinal girders extending parallel to the axis of rotation of the carrier structure, arranged radially inwardly of said carrier structure and fixed thereto, the said longitudinal girders being regularly spaced over a complete circumference, so as to form between them the recesses for the moulds.

4. A factory according to claim 3, characterised in that the longitudinal girders of the resistant structure have a cross-section of substantially isosceles trapezoid form, the small base of which is turned towards the axis of rotation of the rotary housing.

5. A factory according to claim 4, characterized in that the walls opposite of two successive longitudinal girders extend radially such that the moulds may be inserted in or removed from the space included between the girders by radial displacement.

6. A factory according to claim 1, wherein said elongate members comprise at least two longitudinal girders arranged one after the other, between which are placed casting means, arranged after one another, such that a number of concrete products are aligned one behind the other between the girders, and the reinforcement wires extend along the entire length of the longitudinal girders so as to pass through several successive moulds.

7. A factory according to claim 6, characterized in that the concrete casting means comprises:

a shell formed by the assembly of a plurality of unit moulds placed side by side transversely, each unit mould permitting fabrication of the product, a framework on which the shell is fixed, the said framework being carried by the longitudinal girders, and a cover which, in the operative position thereof, rests on the surface of the concrete contained in the moulds forming said shell and as to be separated from the shell.

8. A factory according to claim 6, characterised in that the casting means are mounted between the longitudinal girders for permitting sliding in the londitudinal direction of the said girders.

9. A factory according to claim 6 characterized in that said tensioning means comprise a device permitting the tension applied to the reinforcement wires to be gradually reduced.

10. A factory according to claim 9, characterized in that the device permitting gradual reduction of the tension comprises stop means at one end of the longitudinal girders at which end the application of tension is effected, and means for the continuous adjustment of the longitudinal position of the stop means with respect to the longitudinal end of the girders.

11. A factory according to claim 10, characterized in that the means for the continuous adjustment of the longitudinal position of the stop means comprise a screw fixed to the end of the girders and a nut mounted on the said screw, and acting as retention member for a stop of the stop means when a pull is exerted on the reinforcement wires.

12. A factory according to claim 10, characterized in that the means for the continuous adjustment of the longitudinal position of the stop means comprises a device having wedges having surfaces with reciprocal slopes, the said wedges being placed between a pulling head integral with the stop means and a fixed stop formed by a longitudinal end of the girders, the whole being such that the movement of the pulling head in a direction perpendicular to the reinforcements is accompanied, owing to the arrangement of the wedges by a gradual reduction in the distance between the stop means of the pulling head and the longitudinal end of the girders.

13. A factory according to claim 12, further comprising push means operatively associated with said pulling head for assisting in controlling the movement of the pulling head in a direction perpendicular to the reinforcement wires during stripping of concrete products.

14. A factory according to claim 12, further comprising means, disposed at the end of the girders remote from the pulling head, for the attachment of the ends of the reinforcement wires bearing against the end of the girders by means of a device having wedges defining stop surfaces having reciprocal slopes.

15. A factory according to claim 1 wherein said concrete-casting installation comprises covers, adapted to be separated from the moulds, for covering the moulds, and further comprises means for removing the covers from the moulds when the concrete has set sufficiently, and for returning the said covers to the moulds at the end of the operation of pouring the concrete.

16. A factory according to claim 15, wherein said elongate members comprise longitudinal girders and wherein the moulds are arranged in rows one after the other between pairs of said longitudinal girders, the covers of one row being carried by a longitudinal supporting element, and means for holding the supporting element are provided at each end thereof.

17. A factory according to claim 16, wherein the ends of said supporting element include rollers and the means for holding the supporting element comprise a circular arc rail adapted to bear against the rollers of said supporting element, and the means for removing the covers comprise, at the upper end of the rail, a pivotal element for assisting the movement of the supporting element and covers to the operative, mould covering positions thereof.

18. A factory according to claim 1 wherein said concrete-casting installation comprises means for pouring concrete to said moulds comprising a transport truck adapted to receive the concrete to be poured and to move along a row of said moulds, and an intermediate feed truck provided between a principal bin containing the concrete and the transport truck, the said feed truck being adapted to slide longitudinally, following the direction of the sets of moulds, and to be filled with concrete from the bin containing the concrete, when the transport truck is moved for filling the moulds, the said feed truck collecting an amount of concrete corresponding to that necessary for filling a mould, the said feed truck having a bottom adapted to be opened widely for ensuring a rapid transfer of the concrete contained in the feed truck to the transport truck when the feed truck is above the transport truck.

19. A factory according to claim 18, characterised in that said concrete-casting installation comprises a buffer bin arranged between the principal bin and the feed truck.

20. A factory according to claim 18, characterised in that the feed truck and transport truck comprise side walls forming a continuous contour such that the mix collected by the feed truck corresponds to that necessary for filling the moulds according to the type of products to be manufactured, the said walls being placed on a horizontal bottom comprising two shutters adapted to slide horizontally for opening or closing by the action of a hydraulic jack.

21. A factory according to claim 18 further characterized in that said concrete-casting installation comprises guide means and a smoothing device adapted to be moved on said guide means, the said smoothing device being situated in an inoperative position, on the outside of the axial direction of the set of moulds arranged one after the other, the said smoothing device comprising a bin containing concrete, for ensuring complete filling of the moulds, and a vibrating head adapted to move over the upper surface of the moulds, the said vibrating head comprising a scraping element and being supported by a vertical lifting device enabling it to be placed at an appropriate level for crossing obstacles.

22. A factory according to claim 18, further comprising mould-vibrating means formed of at least one horizontal girder for each set of moulds extending perpendicular to the vertical plane passing through the longitudinal axis of the set of moulds and supported by lifting means futher, means operatively associated with said horizontal girder being provided for imparting to the said horizontal girder a vibratory motion, the lifting means being adapted to bring the horizontal girder into contact with the set of moulds while the set of moulds is being filled with concrete.

23. A factory according to claim 22, futher comprising means operatively associated with said mould-vibrating means for attaching the mould-vibrating means to the moulds.

24. A factory according to claim 23, characterised in that the attaching means comprise clamping arms pivoted in the vicinity of their upper ends to a support, while their lower ends are connected by a jack.

25. A factory according to claim 1, wherein the heat-treatment installation comprises a fixed heat screen situated outside the housing and resting on the latter by rotary rollers, the said heat screen comprising a metal framework and a heat screen formed by a sheet of thermally insulating material, a second heat screen being provided in the interior of the rotary housing.

26. A factory according to claim 25, characterised in that a heating means is arranged between the external heat screen and the moulds for sending a heat flow towards the moulds passing by them.

27. A factory according to claim 26, characterised in that the heating means comprise infra-red radiators.

28. A factory according to claim 1 wherein said mould-stripping installation comprises a head carried by a jointed tube and comprising recesses adapted to receive the cast products, means for controlling a movement in translation and rotation of the head, the means for stripping cast products from the moulds.

29. A factory according to claim 28, wherein said stripping means includes push means comprising push fingers adapted to exert a thrust against the cast products for loosening the said products with respect to the moulds.

30. A factory according to claim 1 further comprising an installation mounted on said construction for feeding said reinforcement wires that comprises a feed device, for feeding said reinforcement wires, comprising a tubular element around which are arranged at regular intervals crowns provided with radial grooves opening into the external periphery of the crowns, the said grooves being adapted to receive the reinforcement wires the tubular element being given a movement of rotation such that, for a predetermined inclination of the groove containing a reinforcement wire, the latter escapes from the said groove by gravity.

31. A factory according to claim 30, further comprising a split tube arranged above the feed device for the reinforcement wires, the said split tube comprising a longitudinal slot and being adapted to turn on its axis so that the longitudinal slot occupies the lower part of the said tube when a cut reinforcement wire is intended to drop into the feed device.

* * * * *